US011062554B2

(12) United States Patent
Cohen

(10) Patent No.: US 11,062,554 B2
(45) Date of Patent: Jul. 13, 2021

(54) DECENTRALIZED DISTRIBUTED PEER-TO-PEER WAGERING ARCHITECTURE AND RELATED SYSTEMS AND METHODS

(71) Applicant: IGT, Las Vegas, NV (US)

(72) Inventor: Charles Cohen, San Francisco, CA (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/511,652

(22) Filed: Jul. 15, 2019

(65) Prior Publication Data

US 2021/0019987 A1 Jan. 21, 2021

(51) Int. Cl.
*G07F 17/32* (2006.01)

(52) U.S. Cl.
CPC ..... *G07F 17/3223* (2013.01); *G07F 17/3244* (2013.01); *G07F 17/3288* (2013.01)

(58) Field of Classification Search
None
See application file for complete search history.

(56) References Cited

U.S. PATENT DOCUMENTS

2006/0148555 A1* 7/2006 Dent ..... G06Q 50/34 463/25
2018/0035014 A1* 2/2018 Koizumi ..... H04N 1/4433
2018/0101842 A1* 4/2018 Ventura ..... G06F 16/27
2018/0190077 A1 7/2018 Hall et al.
2018/0216946 A1 8/2018 Gueye
2018/0285879 A1 10/2018 Gadnis et al.
2018/0294967 A1* 10/2018 Roberts ..... H04L 9/3297
2018/0315046 A1 11/2018 Joao

* cited by examiner

*Primary Examiner* — Ronald Laneau
(74) *Attorney, Agent, or Firm* — Sage Patent Group

(57) ABSTRACT

Systems and methods are provided. A system includes a communication interface, a processor circuit and a memory coupled to the processor circuit. The memory includes machine readable instructions that, when executed by the processor circuit, cause the processor circuit to generate, within a decentralized distributed peer-to-peer wagering architecture, a data block that includes a smart betting contract that manages a wager that is between a plurality of betting parties. The processor circuit further determines a wager outcome based on an event outcome based on a condition that is defined in the smart betting contract and, based on the wager outcome, executes the smart betting contract to cause a value that corresponds to the wager to be transmitted to one of the betting parties.

20 Claims, 8 Drawing Sheets

DECENTRALIZED DISTRIBUTED PEER-TO-PEER WAGERING ARCHITECTURE AND RELATED SYSTEMS AND METHODS

BACKGROUND OF THE DISCLOSURE

Currently there are two models for large scale betting markets. Examples of such markets include commercial sports betting markets. One model is a traditionally designed sportsbook that makes an offer of a range of betting opportunities and acts as a counterparty in each betting contract with a bettor. Another model includes a betting exchange in which individuals are matched by a platform that does not act as a counterparty in the wagers, but that administers the taking of money and the settlement of bets between the individuals. However, in both cases, the platform acts as both a market maker and clearing house for the betting transactions.

BRIEF SUMMARY OF THE DISCLOSURE

Some embodiments are directed to a system including a communication interface, a processor circuit and a memory coupled to the processor circuit. The memory includes machine readable instructions that, when executed by the processor circuit, cause the processor circuit to generate, within a decentralized distributed peer-to-peer wagering architecture, a data block that includes a smart betting contract that manages a wager that is between a plurality of betting parties that includes a first betting party and a second betting party and that corresponds to an event. In some embodiments, the wager may correspond to more than one event. The processing circuit further determines a wager outcome based on one or more event outcomes based on a condition that is defined in the smart betting contract and, based on the wager outcome, executes the smart betting contract to cause a value that corresponds to the wager and/or terms thereof to be transmitted to one or more of the plurality of betting parties.

Some embodiments are directed to methods that perform operations including receiving betting offer data corresponding to a betting offer from a first betting party, the betting offer data defining wager terms for a smart betting contract, receiving acceptance data that corresponds to an acceptance from a second betting party that indicates that the second betting party has accepted the betting offer from the first betting party, generating, within a blockchain, a data block that comprises the smart betting contract that manages the wager between the first betting party and the second betting party and that corresponds to an event, determining a wager outcome based on a condition that is defined in the smart betting contract, and based on the wager outcome, executing the smart betting contract to cause a value that corresponds to the wager to be transmitted to a corresponding one of the first betting party and the second betting party.

Some embodiments are directed to systems that include a communication interface, a processor circuit and a memory that is coupled to the processor circuit and that includes machine readable instructions that, when executed by the processor circuit, cause the processor circuit to perform operations including receive betting offer data corresponding to a betting offer from a first betting party, the betting offer data defining wager terms for a smart betting contract, receive acceptance data that corresponds to an acceptance from a second betting party that indicates that the second betting party has accepted the betting offer from the first betting party to form a wager, generate, within a blockchain, a data block that comprises the smart betting contract that manages between the first betting party and the second betting party and that corresponds to an event and determine a wager outcome based on a condition that is defined in the smart betting contract. Based on the wager outcome, the smart betting contract self-executes to cause value that corresponds to the wager to be transmitted to a corresponding one of the first betting party and the second betting party. Although described as being directed to two betting parties, systems herein may be directed to embodiments including more than two betting parties.

DETAILED DESCRIPTION OF THE DISCLOSURE

Figure 1:
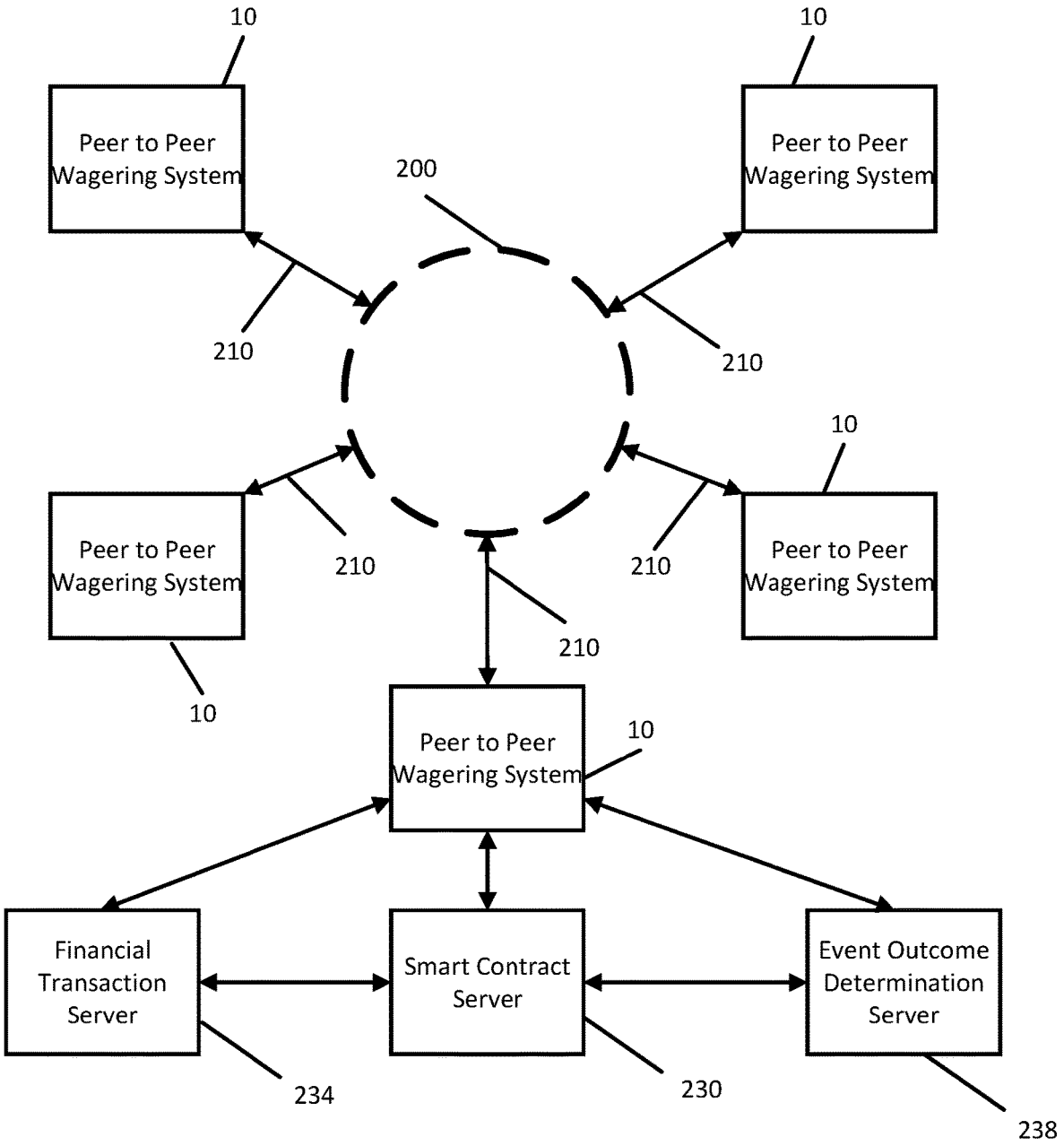
FIG. 1 is a schematic block diagram illustrating a system architecture according to some embodiments herein.

Some embodiments herein provide a peer-to-peer betting service in which individuals can bet against each other at a scale and in complex associations with each other. As such, embodiments herein provide a technical solution to the technical problem of needing a centralized clearing house such as a sports book or exchange.

In some embodiments provided herein, instead of entering into a contract with a sportsbook and/or exchange, individual bettors may enter into smart contracts with each other. A smart contract may be a computer protocol that is intended to digitally facilitate, verify, and/or enforce the negotiation and/or performance of a contract. Smart contracts may allow the performance of credible transactions without third parties. Such transactions are generally, trackable and are not reversible. These smart contracts may be secured using a blockchain. A non-limiting example of a blockchain technology that supports the smart contract includes Etherium, among others.

Each smart contract may include information about the wager. Such information may include the amount of the wager, the agreed upon odds, the wagering market, the time the wager is struck, the identities of the parties, the rules of the wager against which the outcome will be determined. Wager information may further include conditional outcomes based upon each potential outcome, including the facilitation of payment from the loser to the winner, and/or the return of funds in event of a void or cancellation. In some embodiments, a settlement service may be agreed upon between the parties.

Some embodiments provide that the smart contracts may be generated at wagering terminals, on individual PC's, on a mobile device and/or in the cloud. Such examples are non-limiting as the smart contracts may be generated at a variety of other devices and/or types thereof. In some embodiments, each smart contract may involve external services at the discretion of the betting parties. In some embodiments, a range of options may be selected by the betting parties at the time the smart contract is generated.

In some embodiments, computer software and access to the information necessary to each counterparty to place a wager, such as the current market price of a bet, may be commercially provided. In some embodiments, instead of a commercial data provided, bettors may agree to bet on whatever they want, at whatever price they want. Some embodiments provide that services that perform the same pricing and matching functions of betting exchanges may also provide a service of matching bettors to form smart contracts with each other. Such services may be advantageous for circumstances in which multiple counterparties may be aggregated into a single wager. For example, a first bettor may wager $10 at 100:1 against an event outcome. Such wager may be conducted by entering into 500 contracts with different second bettors. In each contract, if the first bettor loses the wager, he may pay 2 cents to each of the second bettors. If the first bettor wins, then he may receive $2 from each of the second bettors.

Some embodiments provide that a smart contract may be registered with a settlement service provider that is agreed to by the bettors. In some embodiments, a settlement service may provide information about the outcome of the event on which the wager is made. In some embodiments, the settlement service may send the information to the counterparties, which may trigger the settling of the wager under the terms of the smart contract. In some embodiments, the process may involve the winning bettor using the smart contract to initiate the payment from the losing party through a manual process. For example, the winning bettor may initiate a bank transfer based on the smart contract. In some embodiments, the process may be automated by software on a computer and/or server controlled by one of the bettors. Embodiments herein do not require the funds to be held in any kind of ESCROW, however, such option is contemplated by this disclosure. For example, embodiments herein are directed to any financial settlement process that may be used in conjunction with the smart contracts as disclosed herein.

Some embodiments provide that the settlement transaction may be stored in blockchain to close the contract. In some embodiments, details corresponding to the settlement transaction may be retained for auditing, later scrutiny and/or to ensure that no errors are made.

Reference is now made to FIG. 1, which is a schematic block diagram illustrating a system architecture according to some embodiments herein. The architecture may provide that multiple instances of a peer-to-peer wagering system 10 may be provided. Each of the peer-to-peer wagering systems 10 may have access to a decentralized distributed market that is provided as a blockchain 200. The blockchain 200 may include multiple different data blocks that each correspond to smart contracts between multiple different bettors in a peer-to-peer wagering system. In some embodiments, each peer-to-peer wagering system 10 may store and/or cause to be stored an instance of the blockchain 200, which may include a communication channel 210 to the blockchain 200. In this manner, each peer-to-peer wagering system may be communicatively coupled, directly and/or indirectly, to every other peer-to-peer wagering system 10 that is part of the peer-to-peer wagering system architecture. Although not illustrated in this figure, some embodiments provide that intervening networks may be included in the communication channel 210.

In some embodiments, the peer-to-peer wagering system 10 may include and/or be communicatively coupled to a smart contract server 230. A smart contract server 230 may generate, store, initiate, and/or finalize a smart contract that is the basis for a peer-to-peer wager as disclosed herein. For example, the smart contract server 230 may provide a template for a bettor to offer a wager to others. The template may include specific information needed for the formation of a smart contract including identification of the event, identification of the parties (e.g., the bettors), the amount of the wager, terms of the wager, financial information, and/or an event outcome validation source, among others. Once the specific information is determined, the smart contract server 230 may publish a wager offer that is based on the smart contract. In some embodiments, the smart contract may further provide an option for a partial acceptance of the smart contract by another bettor. For example, a wager may be established based on a portion of the amount of the wager. In some embodiments, multiple wagers may be established based on multiple bettors accepting respective portions the published wager offer.

In some embodiments, the peer-to-peer wagering system 10 may include and/or be communicatively coupled to a financial transaction server 234. In some embodiments, the financial transaction server 234 may receive funds and/or payment obligations from bettors using the peer-to-peer wagering system 10. For example, some embodiments provide that the financial transaction server 234 may hold funds in an ESCROW account until the outcome of the event is determined and the winning bettor is identified. In some embodiments, the financial transaction server 234 may, based on the terms of the smart contract, automatically disburse the wager winning amount to the winning bettor.

In some embodiments, the peer-to-peer wagering system 10 may include and/or be communicatively coupled to an event outcome determination server 238. The event outcome determination server 238 may, based on the terms identified in the smart contract, determine the outcome of an event upon which the wager is based and based on the terms of the smart contract. Some embodiments provide that the event outcome determination server 238 is expressly identified is the terms of the smart contract. Although the financial transaction server 234, the smart contract server 230 and the event outcome determination server 238 are illustrated and discussed as operating on separate servers, embodiments herein provide that any combination thereof may be used in a peer-to-peer wagering system 10 and/or instance thereof.

Figure 2:
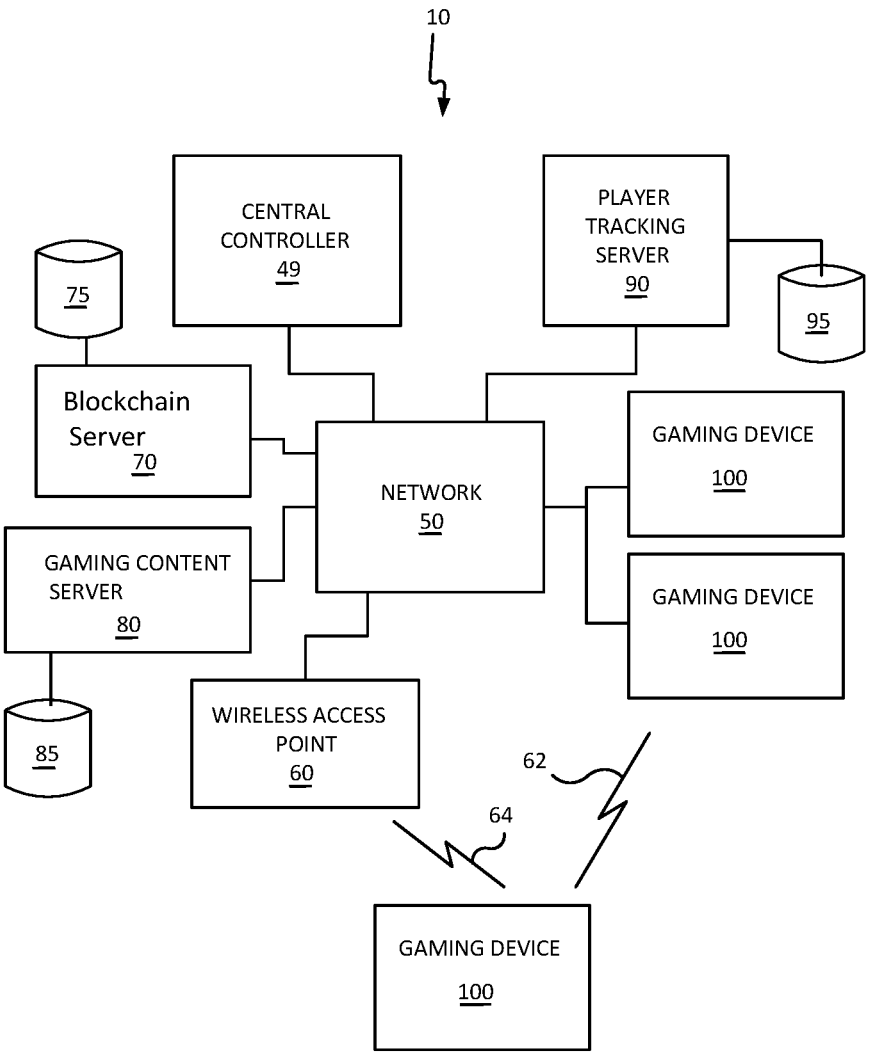
FIG. 2 illustrates a system according to some embodiments herein.

Reference is now made to FIG. 2, which illustrates a peer-to-peer wagering system 10. The peer-to-peer wagering system 10 may be located, for example, on the premises of a gaming establishment, such as a casino, in a private residence, or may include components that are located at different locations. Some embodiments provide that gaming devices may provide options, inputs and/or access for peer-to-peer wagering operations. In some embodiments, gaming devices 100 may be in communication with each other and/or a central controller 49 through a data communication network 50, or remote communication link. The data communication network 50 may be a private data communication network that is operated, for example, by the gaming facility that operates the gaming device 100, a publicly accessible data communication network such as the Internet, or a combination thereof. Communications over the data communication network 50 may be encrypted for security. The central controller 49 may be any suitable server or computing device which includes at least one processor circuit, such as a processor, and at least one memory or storage device. Each gaming device 100 may include a processor circuit that transmits and receives events, messages, commands or any other suitable data or signal between the gaming device 100 and the central controller 49 and/or other gaming devices 100. The gaming device processor is operable to execute such communicated events, messages or commands in conjunction with the operation of the gaming device 100. Moreover, the processor of the central controller 49 is configured to transmit and receive events, messages, commands or any other suitable data or signal between the central controller 49 and each of the individual gaming devices 100. In some embodiments, one or more of the functions of the central controller 49 may be performed by one or more gaming device processors. Moreover, in some embodiments, one or more of the functions of one or more gaming device processors as disclosed herein may be performed by the central controller 49.

A wireless access point 60 provides wireless access to the data communication network 50. The wireless access point 60 may be connected to the data communication network 50 as illustrated in FIG. 2 or may be connected directly to the central controller 49 or another server connected to the data communication network 50.

One or more content servers, such as a gaming content server 80, may also be connected through the data communication network 50. Similarly, the gaming content server 80 may manage delivery of the gaming content to the user of a gaming device 100. The gaming content may be stored in a gaming content database 85. A blockchain server 70 may manage access, update, storage, consensus determination, and/or excluded player identification corresponding to the consortium blockchain 200. The blockchain data may be stored in a blockchain database 75. The blockchain server 70 and a gaming content server 80 may be implemented within or separately from each other. The blockchain server 70 and a gaming content server 80 may also be implemented within or separately from the central controller 49.

A player tracking server 90 may also be connected through the data communication network 50. The player tracking server 90 may manage a player tracking account that tracks the gameplay and spending and/or other player preferences and customizations of a player, i.e., the user of the gaming device 100, manages loyalty awards for the player, manages funds deposited or advanced on behalf of the player, and other functions. Player information managed by the player tracking server 90 may be stored in a player information database 95.

Some embodiments provide that the gaming device 100 includes one or more user interfaces to provide peer-to-peer wagering system access using the smart contract and blockchain disclosed herein. For example, in some embodiments, the gaming device 100 includes a sports betting terminal, among others.

The gaming devices 100 communicate with one or more elements of the peer-to-peer wagering system 10 to coordinate providing peer-to-peer wagering. For example, in some embodiments, a gaming device 100 may communicate directly with another gaming device 100 over a wireless interface 62, which may be a WiFi link, a Bluetooth link, an NFC link, etc. In other embodiments, the gaming device 100 may communicate with the data communication network 50 (and devices connected thereto, including EGMs) over a wireless interface 64 with the wireless access point 60. The wireless interface 64 may include a WiFi link, a Bluetooth link, an NFC link, etc. In still further embodiments, the gaming device 100 may communicate with other gaming devices 100 or other devices over the wireless interface 62 and the wireless access point 60 over the wireless interface 64. In these embodiments, the wireless interface 62 and the wireless interface 64 may use different communication protocols and/or different communication resources, such as different frequencies, time slots, spreading codes, etc. For example, in some embodiments, the wireless interface 62 may be a Bluetooth link, while the wireless interface 64 may be a WiFi link.

The wireless interfaces 62, 64 allow the gaming devices 100 and/or central controller 49 to coordinate providing player data from gaming devices 100.

Figure 3:
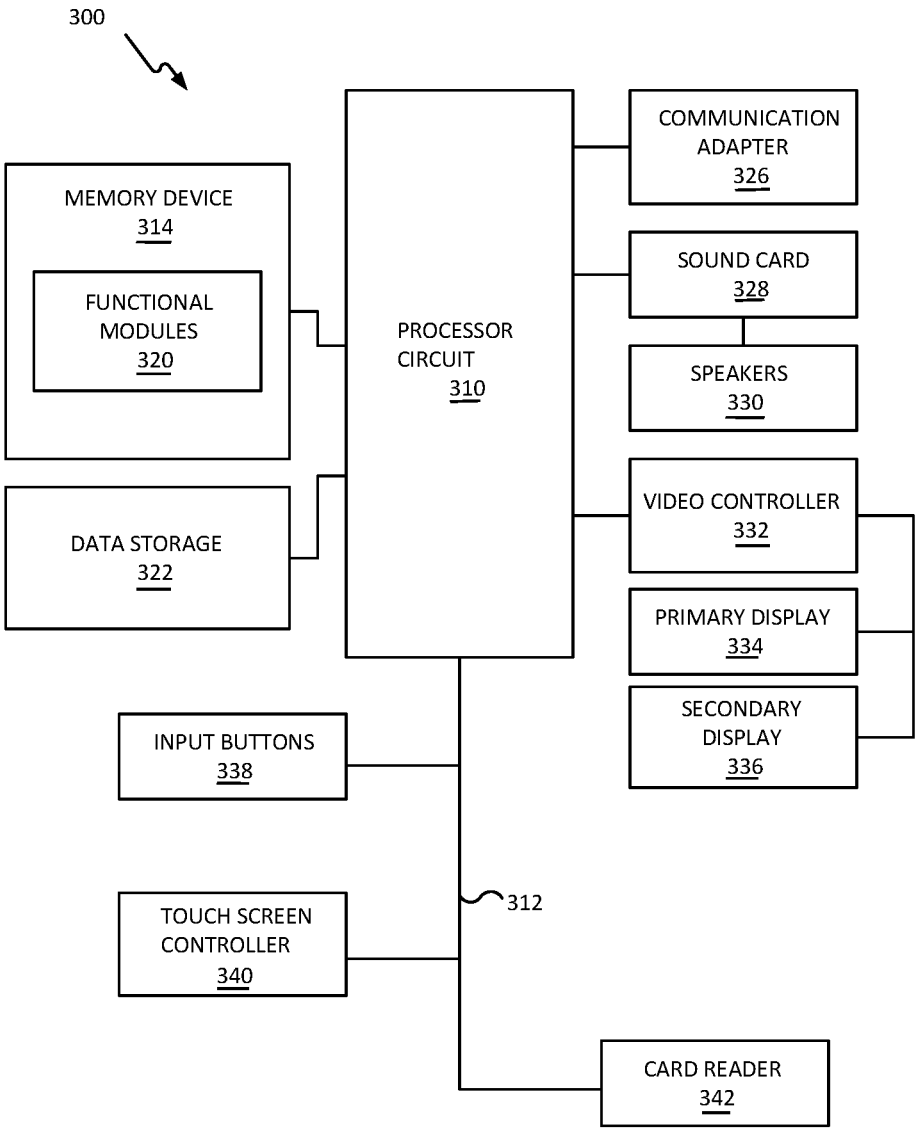
FIG. 3 is a block diagram that illustrates various components of a computing device that may embody or be included as part of the devices, systems, and/or components above, according to some embodiments.

Reference is now to FIG. 3, which is a block diagram that illustrates various components of a computing device 300, which may embody or be included as part of the devices, systems, and/or components above, according to some embodiments. As shown in FIG. 3, the computing device 300 may include a processor circuit 310 that controls operations of the computing device 300. Although illustrated as a single processor, multiple special purpose and/or general-purpose processors and/or processor cores may be provided in the computing device 300. For example, the computing device 300 may include one or more of a video processor, a signal processor, a sound processor and/or a communication controller that performs one or more control functions within the computing device 300. The processor circuit 310 may be variously referred to as a "controller," "microcontroller," "microprocessor" or simply a "computer." The processor circuit 310 may further include one or more application-specific integrated circuits (ASICs).

Various components of the computing device 300 are illustrated in FIG. 3 as being connected to the processor circuit 310. It will be appreciated that the components may be connected to the processor circuit 310 and/or each other through one or more buses 312 including a system bus, a communication bus and controller, such as a USB controller and USB bus, a network interface, or any other suitable type of connection.

The computing device 300 further includes a memory device 314 that stores one or more functional modules 320 for performing the operations described above. Alternatively, or in addition, some of the operations described above may be performed by other devices connected to the network, such as the network 50 of the peer-to-peer wagering system 10 of FIG. 2, for example. The computing device 300 may communicate with other devices connected to the network to facilitate performance of some of these operations. For example, the computing device 300 may communicate and coordinate with certain displays to identify elements of a race being displayed by a particular display.

The memory device 314 may store program code and instructions, executable by the processor circuit 310, to control the computing device 300. The memory device 314 may include random access memory (RAM), which can include non-volatile RAM (NVRAM), magnetic RAM (ARAM), ferroelectric RAM (FeRAM) and other forms as commonly understood in the gaming industry. In some embodiments, the memory device 314 may include read only memory (ROM). In some embodiments, the memory device 314 may include flash memory and/or EEPROM (electrically erasable programmable read only memory). Any other suitable magnetic, optical and/or semiconductor memory may operate in conjunction with the gaming device disclosed herein.

The computing device 300 may include a communication adapter 326 that enables the computing device 300 to communicate with remote devices, such as the wireless network, another computing device 300, and/or a wireless access point, over a wired and/or wireless communication network, such as a local area network (LAN), wide area network (WAN), cellular communication network, or other data communication network, e.g., the network 50 of FIG. 2.

The computing device 300 may include one or more internal or external communication ports that enable the processor circuit 310 to communicate with and to operate with internal or external peripheral devices, such as a sound card 328 and speakers 330, video controllers 332, a primary display 334, a secondary display 336, input buttons 338 or other devices such as switches, keyboards, pointer devices, and/or keypads, a touch screen controller 340, a card reader 342, currency acceptors and/or dispensers, cameras, sensors such as motion sensors, mass storage devices, microphones, haptic feedback devices, and/or wireless communication devices. In some embodiments, internal or external peripheral devices may communicate with the processor through a universal serial bus (USB) hub (not shown) connected to the processor circuit 310. Although illustrated as being integrated with the computing device 300, any of the components therein may be external to the computing device 300 and may be communicatively coupled thereto. Although not illustrated, the computing device 300 may further include a rechargeable and/or replaceable power device and/or power connection to a main power supply, such as a building power supply.

In some embodiments, the computing device 300 may include a head mounted device (HMD) and may include optional wearable add-ons that include one or more sensors and/or actuators. Including ones of those discussed herein. The computing device 300 may be a head-mounted mixed-reality device configured to provide mixed reality elements as part of a real-world scene being viewed by the user wearing the computing device 300.

Figure 4:
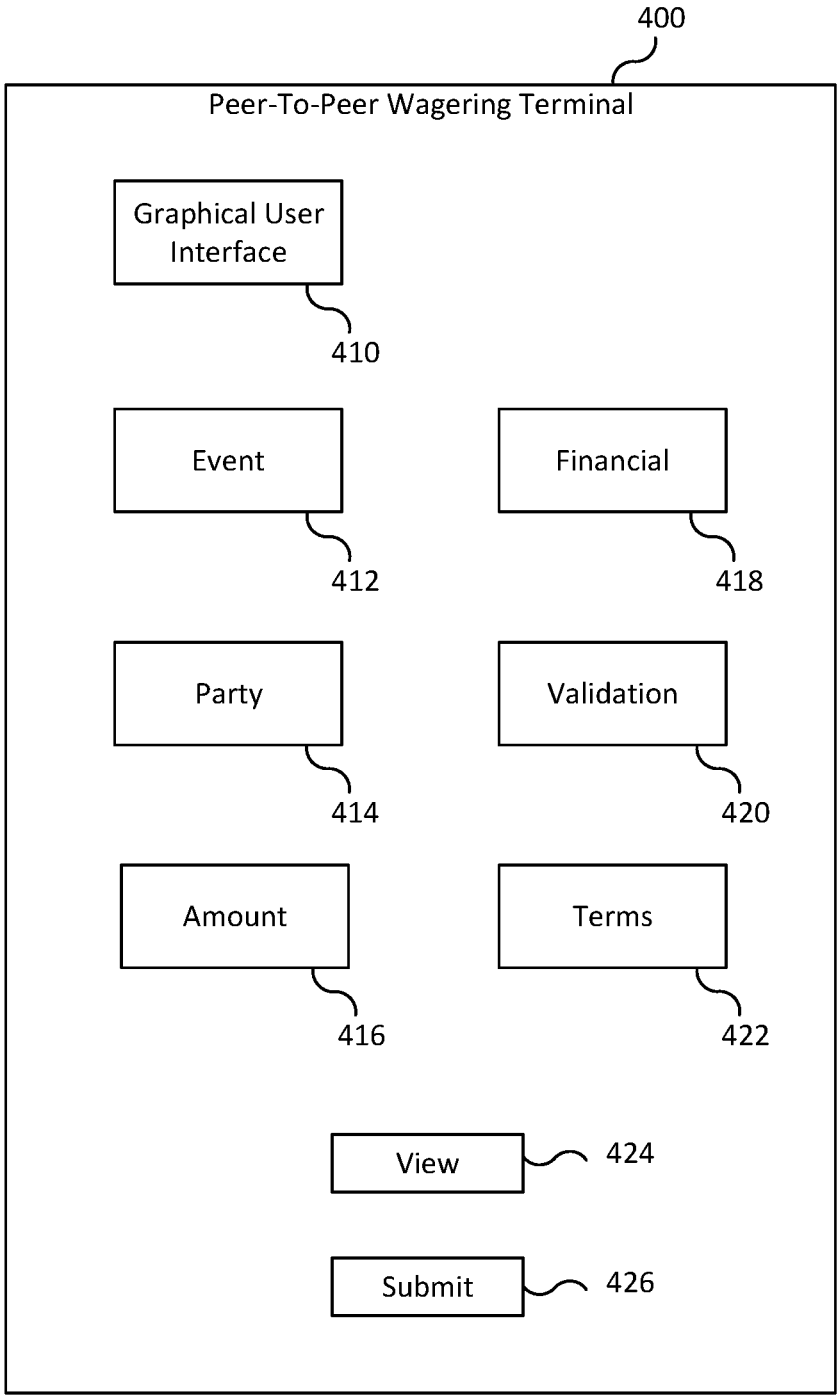
FIG. 4 is a schematic block diagram illustrating a peer-to-peer wagering terminal illustrating a schematic user interface according to some embodiments.

Reference is now made to FIG. 4, which is a schematic block diagram illustrating a peer-to-peer wagering terminal illustrating a schematic user interface according to some embodiments.

As illustrated, the peer-to-peer wagering terminal 400 may include a graphical user interface 410 for creating peer-to-peer wagers that may be stored and automatically executed within a system according to some embodiments. A bettor may generate and send an offer to wager by accessing a peer-to-peer betting graphical user interface (GUI) 410 (e.g., via a player terminal, mobile phone, smart television, etc.) Once the offer to wager is accepted by another bettor, a peer-to-peer wager is created. The peer-to-peer wager is executed by a smart contract that is stored as a data block in a decentralized distributed architecture such as a blockchain. The wager may be with one or more individuals and/or parties. The bettor can enter specific information for the wager. For example, the bettor may select an event, such as a sports event using an event input 412 on the GUI 410 to create a sports bet with another player on the outcome of the sporting event. In some embodiments, the event input 412 may include one or more drop down menus and/or search fields for selecting available events. The event may be defined in terms of one or more competitors, such as a specific upcoming game between two specific NFL teams. In some embodiments, the event may be defined based on the performance of a single competitor or team, such as, whether a given competitor will win an otherwise undefined event such as the Superbowl or other tournament title.

As another example, a bettor may create a wager on the outcome of non-sporting events such as the winner of other competitions such as video games and/or tournaments, card games and/or tournaments, election results, weather outcomes, etc. The event may be further defined to include a given time interval such as a one-time score, an average score over a day, week, or month, etc. and/or the occurrence of an event over a given time interval.

Financial terms of the wager may be received from the bettor via a financial input 418. The financial input 418 may identify the terms of funds to be deposited in advance of the wager and/or payment terms corresponding to the completion of a wager, among others. In some embodiments, the financial input 418 may include one or more drop down menus and/or search fields for selecting available financial options.

A bettor may modify and/or select one or more wager parties using a wager party input 414. Some embodiments provide a potential bettor considering the accepting a published wager may be able to accept the wager by providing his identifying information via the wager party input 414. In some embodiments, the wager party input 414 may be used to select a specific party to conduct the wager with. For example, a bettor may offer the wager to a specific other bettor or group of bettors.

An amount input 416 may be used by the initiating bettor to indicate the amount of the wager. In some embodiments, other bettors may accept a portion or the entire amount provided in the original wager offering. The betting amounts can be placed in escrow, where funds may be removed from a digital wallet of a player while a wager is pending.

In some embodiments, a wager may be cancelled. One or more validation sources may be identified in a validation input 420. The validation sources may be selected and will be used to verify the results. The peer-to-peer wagering system may include rules engine that interfaces with a wagering platform and a blockchain protocol, that is used for generation of blockchain. The rules engine may process any additional terms 422 and may include one or more components (e.g., hardware, software or a combination thereof) that ensure compliance with any rules or regulations. The rules engine may execute processing operations that translate the peer-to-peer wager into a smart contract, which can be stored on as one or more data blocks of a blockchain.

The GUI 410 may include a view input 424 for viewing the proposed wager and a submit input 426 for submitting the wager to a wager market and/or for accepting a wager that is published on the wager market. Once the wager is accepted, the corresponding smart contract may be recorded to a blockchain.

Some embodiments provide that there could be multiple places or sources that confirm the wager. The rules engine may further be configured to provide trust levels and/or rankings so that those validation sources with a higher ranking would agree in view of a conflict. Some other embodiments may use a majority rule, additional verification, or submission to a human for resolution. In this manner, no intermediary may be used. Instead, some embodiments allow for peer-to-peer wager creation, tracking and payout may be performed without a third-party human. Key data that is selected and agreed to between parties can be automatically verified and tracked.

Figure 5:
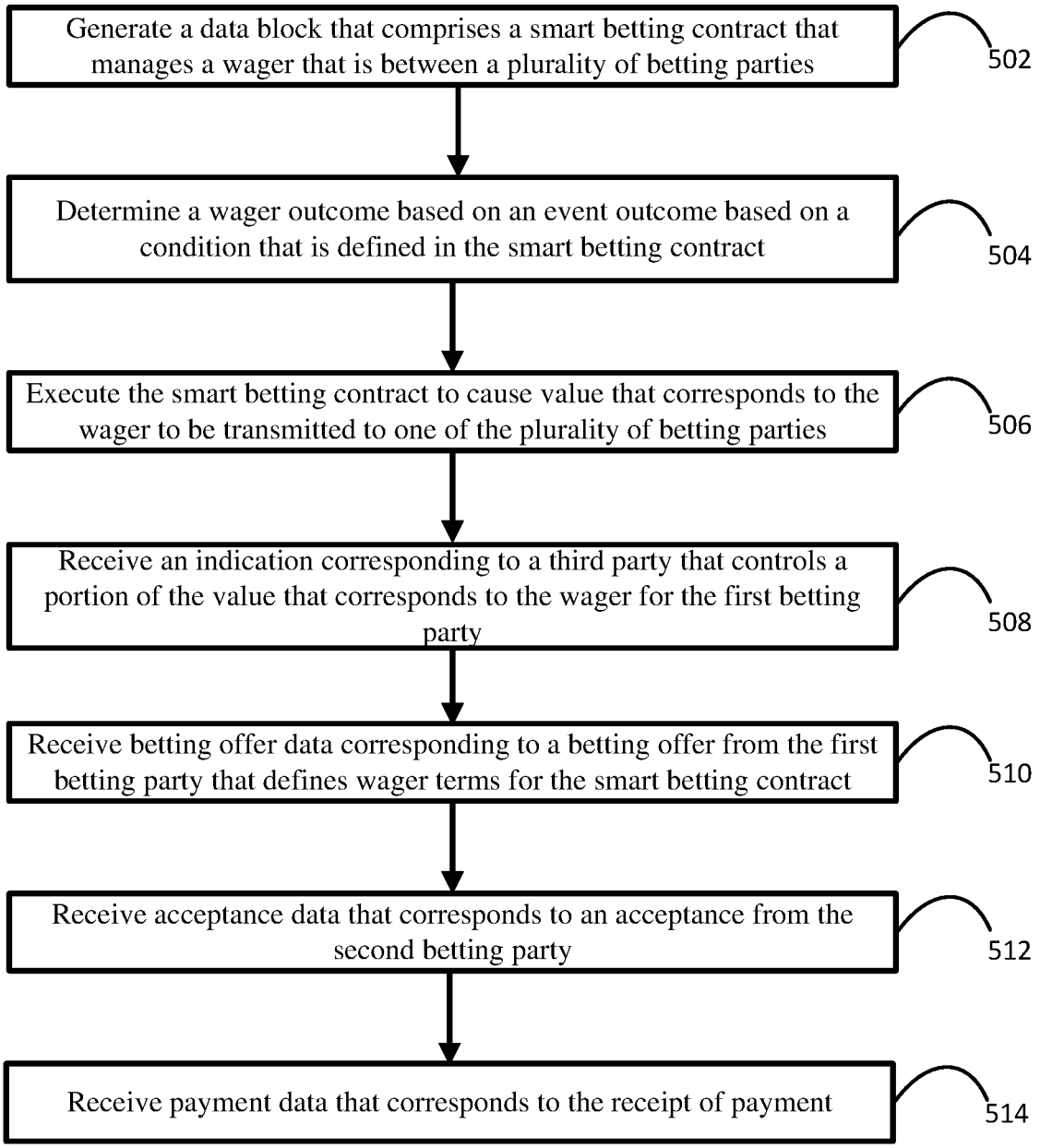
FIG. 5 is a schematic flow diagram illustrating operations of a system for a decentralized distributed peer-to-peer wagering architecture according to some embodiments.

Reference is now made to FIG. 5, which is a schematic flow diagram illustrating operations of a system for a decentralized distributed peer-to-peer wagering architecture according to some embodiments. In some embodiments, operations include generating a data block that includes a smart betting contract that manages a wager that is between multiple betting parties (block 502). Some embodiments provide that the generating is performed within a decentralized distributed peer-to-peer wagering architecture, that the wager is between a first betting party and a second betting party and that the wager corresponds to an event.

Operations may include determining a wager outcome based on an event outcome based on a condition that is defined in the smart betting contract (block 504). Some embodiments provide that, based on the wager outcome, the smart betting contract is executed to cause value that corresponds to the wager to be transmitted to one of the betting parties (block 506). For example, some embodiments provide that the smart betting contract executes to causes the value that corresponds to the wager to be sent by communicating a message that includes an identity and/or approval to another entity, such as, for example a financial institution and/or escrow service, among others.

In some embodiments, the decentralized distributed peer-to-peer wagering architecture is a blockchain and the smart betting contract defines an identification of the first betting party and the second betting party. Some embodiments provide that the first betting party wagers that the event includes a first event outcome, the second betting party wagers that the event includes a second event outcome that is different from the first event outcome and that is mutually exclusive relative to the first event outcome.

In some embodiments, the smart betting contract includes validation data that identifies a validation source that provides data corresponding to the event outcome. Some embodiments provide that, responsive to determining that the wager outcome corresponds to the first event outcome, the smart contract causes the value to be transmitted to the first betting party. In response to determining that the wager outcome corresponds to the second event outcome, the smart contract causes the value to be transmitted to the second betting party.

In some embodiments, the condition that is defined in the smart betting contract includes a fault condition that occurs based on the event outcome being undetermined. In such embodiments, executing the smart betting contract causes a fault condition portion of a value that corresponds to the wager to be transmitted to each of the first and second betting parties.

In some embodiments, prior to generating the data block, the processor circuit receives an indication corresponding to a third party that controls a portion of the value that corresponds to the wager for the first betting party (block 508). Responsive to the event including the first event outcome, the third party is caused to associate the value that corresponds to the wager with the first betting party. Responsive to the event including the second event outcome, the third party is caused to associate the value that corresponds to the wager with the second party.

Some embodiments provide that, prior to generating the data block that includes the smart betting contract that manages the wager that is between the first betting party and the second betting party, the processor circuit further receives betting offer data corresponding to a betting offer from the first betting party that defines wager terms for the smart betting contract (block 510). In some embodiments, the processor circuit further receives acceptance data that corresponds to an acceptance from the second betting party (block 512). In some embodiments, the acceptance indicates that the second betting party has accepted the betting offer from the first betting party. Some embodiments provide that the data block is generated to include the smart betting contract that includes the wager terms in the betting offer, an identity of the first betting party and an identity of the second betting party.

In some embodiments, the betting offer data received from the first betting party includes wager terms that define a first wager amount, the acceptance from the second betting party includes wager terms that define a second wager amount that is less than the first wager amount, and the smart betting contract in the generated data block defines the wager as the second wager amount.

Some embodiments provide that the multiple parties include a third betting party, the data block is a first data block, the smart betting contract is a first smart betting contract, and the acceptance is a first acceptance. The processor circuit further receives a second acceptance from a third betting party that includes wager terms that define a third wager amount and generates, within the blockchain, a second data block that includes a second smart betting contract. In some embodiments, the second acceptance from the third betting party includes wager terms that define a third wager amount, the second smart betting contract includes the third wager amount, and a sum of the second wager amount and the third wager amount is less than the first wager amount.

In some embodiments, the multiple parties include a third betting party, the data block is a first data block, the smart betting contract includes a first smart betting contract, and the acceptance is a first acceptance. The processor circuit is further configured to receive a second acceptance from a third betting party that includes wager terms that define a third wager amount and generate, within the blockchain, a second data block that includes a second smart betting contract. In some embodiments, the second acceptance from the third betting party includes wager terms that define a third wager amount, the second smart betting contract includes a fourth wager amount that is different from the first, second and third wager amounts, and a sum of the second wager amount and the third wager amount is greater than the first wager amount.

In some embodiments, the betting offer data is received via a graphical user interface on a computing device that is communicatively coupled to the processor circuit. Some embodiments provide that the betting offer data includes an identify of the second betting party and the acceptance data is only received from the second betting party.

Some embodiments provide that prior to generating the data block, the processor circuit receives payment data correspond to the receipt of payment from the first betting party and the second betting party (block 514).

In some embodiments, the distributed peer-to-peer wagering architecture includes a blockchain that includes a decentralized distributed digital ledger of the wager between the first betting party and the second betting party. Some embodiments provide that the smart betting contract is self-executing responsive to a condition that is defined therein being satisfied.

Figure 6:
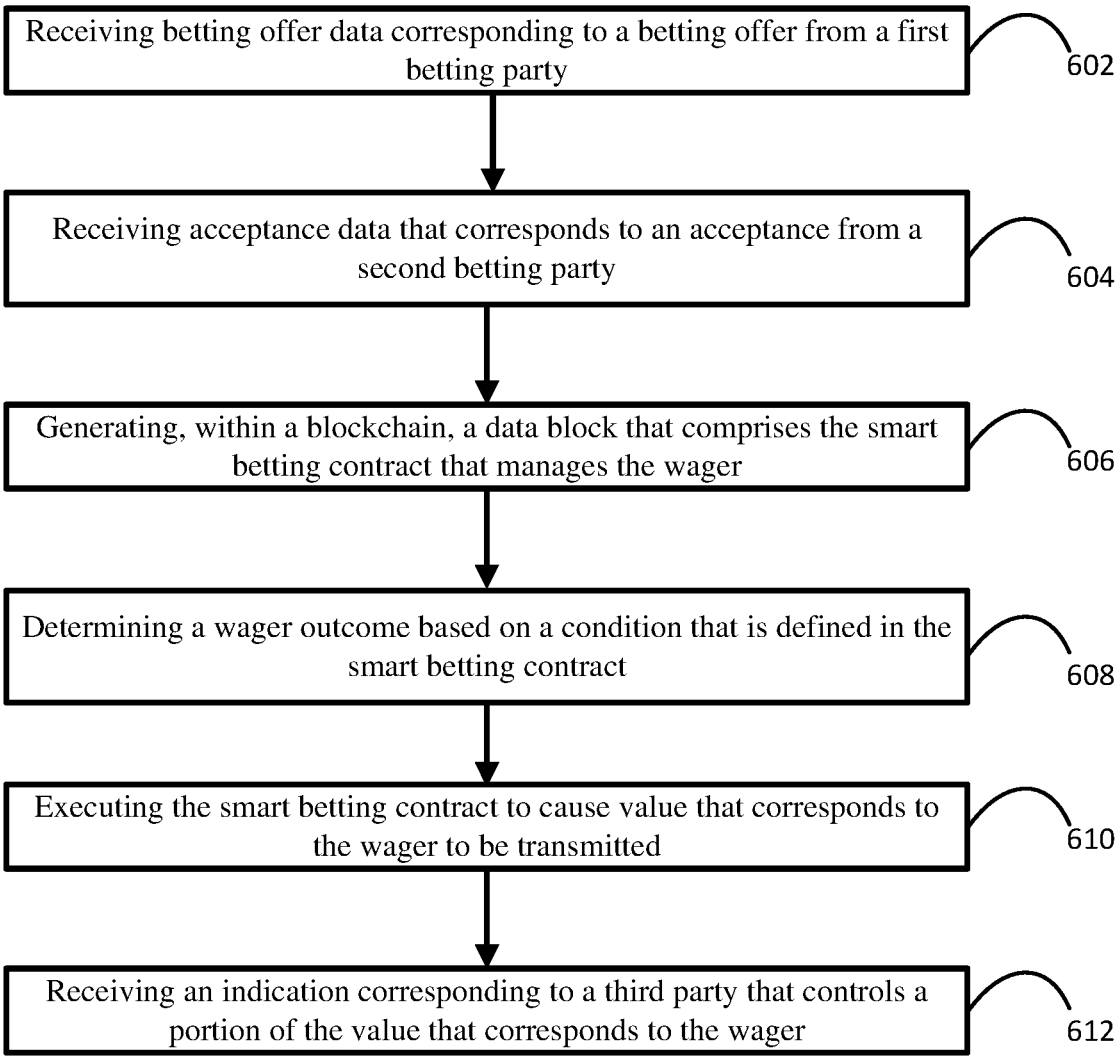
FIG. 6 is a schematic flow diagram illustrating operations of a system for a decentralized distributed peer-to-peer wagering architecture according to some embodiments.

Reference is now made to FIG. 6, which is a schematic flow diagram illustrating operations of a system for a decentralized distributed peer-to-peer wagering architecture according to some embodiments. Operations include receiving betting offer data corresponding to a betting offer from a first betting party (block 602). In some embodiments, the betting offer data defines wager terms for a smart betting contract. Acceptance data that corresponds to an acceptance from a second betting party that indicates that the second betting party has accepted the betting offer from the first betting party is received (block 604). Operations include generating, within a blockchain, a data block that includes the smart betting contract that manages the wager (block 606). In some embodiments, the wager is between the first betting party and the second betting party and corresponds to an event. Operations include determining a wager outcome based on a condition that is defined in the smart betting contract (block 608). Based on the wager outcome, operations include executing the smart betting contract to cause value that corresponds to the wager to be transmitted (block 610). In some embodiments, the wager may be transmitted to the corresponding one of the first betting party and the second betting party.

In some embodiments, the smart betting contract includes validation data that identifies a validation source that provides data corresponding to the event outcome and, responsive to determining that the wager outcome corresponds to the first event outcome, the smart contract causes the value to be transmitted to the first betting party. In response to determining that the wager outcome corresponds to a second event outcome, the smart contract causes the value to be transmitted to the second betting party.

In some embodiments, the condition that is defined in the smart betting contract is a fault condition that occurs based on the event outcome being undetermined. Some embodiments provide that, based on the fault condition occurring, executing the smart betting contract causes a fault condition portion of a value that corresponds to the wager to be transmitted to each of the first betting party and the second betting party.

In some embodiments, prior to generating the data block, operations further include receiving an indication corresponding to a third party that controls a portion of the value that corresponds to the wager for the first betting party and the wager for the second betting party. The event includes a second event outcome and the third party is caused to associate the value that corresponds to the wager with the second party.

In some embodiments, prior to generating the data block that includes the smart betting contract that manages the wager is between the first betting party and the second betting party, the processor circuit further receives betting offer data corresponding to a betting offer from the first betting party that defines wager terms for the smart betting contract. In some embodiments, acceptance data that corresponds to an acceptance from the second betting party that indicates that the second betting party has accepted the betting offer from the first betting party is received. Some embodiments provide that the betting offer data received from the first betting party includes wager terms that define a first wager amount, the acceptance from the second betting party includes wager terms that define a second wager amount that is different than the first wager amount, and the smart betting contract in the generated data block defines the wager as a lower one of the first and second wager amounts.

Figure 7:
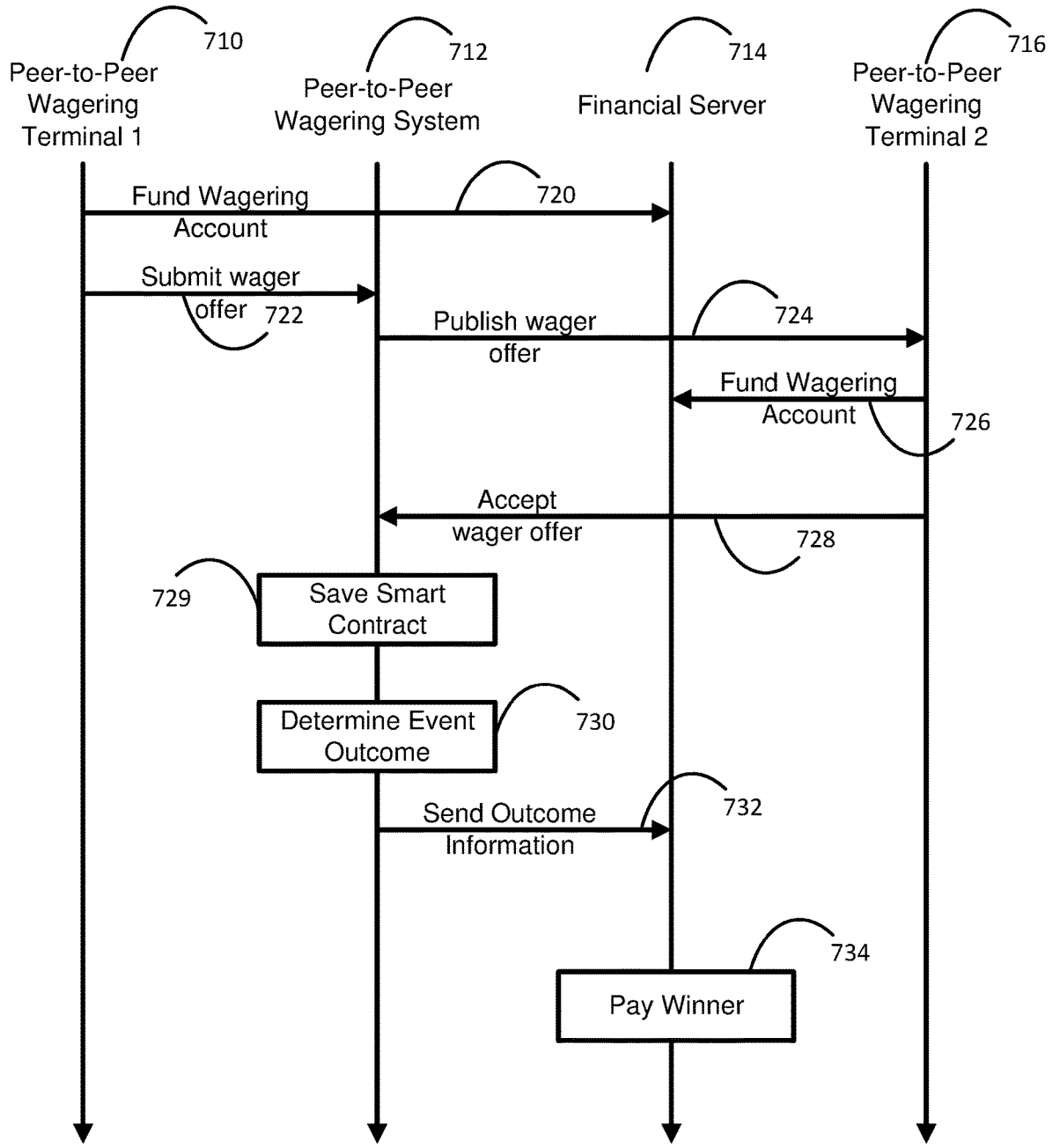
FIG. 7 is a schematic data flow diagram illustration systems and operations for a decentralized distributed peer-to-peer wagering architecture according to some embodiments.

Reference is now made to FIG. 7, which is a schematic data flow diagram illustration systems and operations for a decentralized distributed peer-to-peer wagering architecture according to some embodiments. As illustrated, a first bettor may use peer-to-peer wagering terminal 1 710 to fund a wagering account (operation 720) with a financial server 714. The first bettor may create a wager offer and submit the wager offer (operation 722) to a peer-to-peer wagering system 712. The peer-to-peer wagering system 712 may publish the wager offer (operation 724) to other potential bettors, including the second bettor at the peer-to-peer wagering terminal 2 716. The second bettor may decide to accept the wager offer and fund his wagering account (operation 726) with the financial server 714. The second bettor may accept the wager offer (operation 728). The peer-to-peer wagering system 712 may generate a smart contract and save the smart contract in a data block of a blockchain (operation 729). The peer-to-peer wagering system 712 may determine the event outcome (operation 730 and send the outcome information to the financial server 714 (operation 732). The financial server 714 may pay the winning bettor (operation 734).

Figure 8:
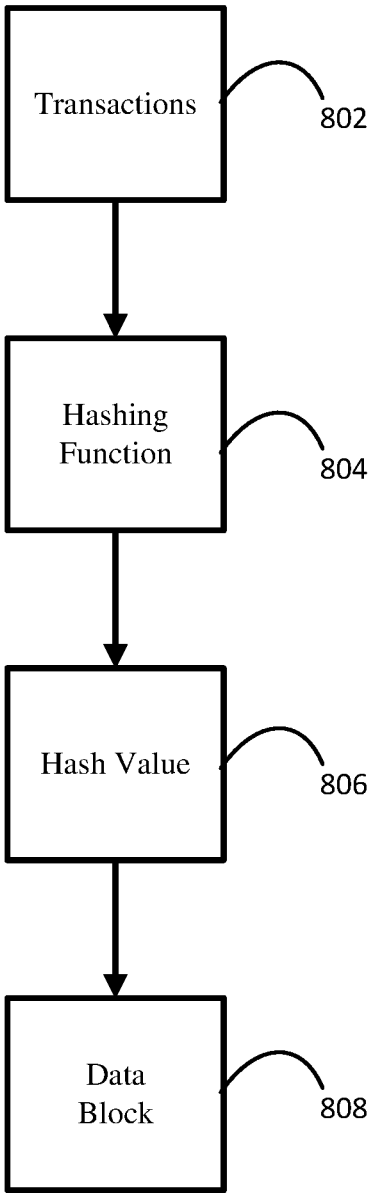
FIG. 8 is a schematic block diagram illustrating various operations for a blockchain transaction according to some embodiments.

Reference is now made to FIG. 8, which is a schematic block diagram illustrating various operations for a blockchain transaction recordation according to some embodiments. As illustrated in FIG. 8, transactions 802 are occurring at various gaming machines. In accordance with various embodiments, a hash may be created for each entry. For example, a cryptographic hash function may create a one-way, (essentially) collision free signature of the entry. The hash algorithm generates a hash. Using hashing function 804, hash values 806 are created of these transactions which are then added to data blocks 808 that are in the blockchain.

As a general principle, a validation process may be performed to ensure that the new data block meets the criteria for inclusion into the blockchain. In a blockchain configuration, there are varying consensus algorithms that can be used. For example, a private blockchain may choose an algorithm such as Practical Byzantine Fault Tolerance (PBFT). The PBFT mechanism may be useful for small networks, such as networks having fewer than about 100 nodes. Other examples include a Proof of Work (PoW) consensus algorithm and/or a Proof of Stake (PoS) consensus algorithm, which may be used as the value of an underlying data block and/or value changes.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks. The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

In some embodiments, a device, apparatus, system and/or computer program product may be described as causing a result and/or action. In such embodiments, causing may include actually performing the action and/or result and/or as performing any action that causes another device, apparatus, system and/or computer program product to cause the result or action.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A system comprising:

a communication interface;

a processor circuit; and a memory coupled to the processor circuit, the memory comprising machine readable instructions that, when executed by the processor circuit, cause the processor circuit to:

receive, via the communication interface and from a first peer-to-peer wagering terminal, betting offer data corresponding to a betting offer from a first betting party;

receive, via the communication interface and from a second peer-to-peer wagering terminal, acceptance data that corresponds to an acceptance of a second betting party that indicates that the second betting party has accepted the betting offer from the first betting party;

generate, using the processor circuit and within a peer-to-peer wagering architecture, a data block that comprises a smart betting contract that manages a wager that is based on the betting offer and is between a plurality of betting parties that comprises the first betting party and the second betting party and that corresponds to an event;

determine a wager outcome based on an event outcome based on a condition that is defined in the smart betting contract; and based on the wager outcome, execute the smart betting contract to cause a value that corresponds to the wager to be automatically transmitted to one of the plurality of betting parties.

2. The system of claim 1, wherein the peer-to-peer wagering architecture comprises a blockchain, wherein the smart betting contract defines an identification of the first betting party and the second betting party, wherein first betting party wagers that the event comprises a first event outcome and the second betting party wagers that the event comprises a second event outcome that is different from the first event outcome and that is mutually exclusive relative to the first event outcome.

3. The system of claim 2, wherein the smart betting contract comprises validation data that identifies a validation source that provides data corresponding to the event outcome, wherein responsive to determining that the wager outcome corresponds to the first event outcome, the smart betting contract causes the value to be transmitted to the first betting party, and wherein responsive to determining that the wager outcome corresponds to the second event outcome, the smart contract causes the value to be transmitted to the second betting party.

4. The system of claim 2, wherein the condition that is defined in the smart betting contract comprises a fault condition that occurs based on the event outcome being undetermined, and wherein based on the fault condition occurring, executing the smart betting contract causes a fault condition portion of a value that corresponds to the wager to be transmitted to each of the first betting party and the second betting party.

5. The system of claim 2, wherein prior to generating the data block, the processor circuit receives an indication corresponding to a third party that controls a portion of the value that corresponds to the wager for the first betting party, wherein the event comprises the first event outcome, and wherein, based on the event comprising the first event outcome, causing the third party associate the value that corresponds to the wager with the first betting party.

6. The system of claim 2, wherein prior to generating the data block, the processor circuit receives an indication corresponding to a third party that controls a portion of the value that corresponds to the wager for the first betting party and the wager for the second betting party, wherein the event comprises the second event outcome, and wherein, based on the event comprising the second event outcome, causing the third party to associate the value that corresponds to the wager with the second betting party.

7. The system of claim 2, wherein the data block is generated to comprise the smart betting contract that comprises the wager terms in the betting offer, an identity of the first betting party and an identity of the second betting party.

8. The system of claim 7, wherein the betting offer data received from the first betting party comprises wager terms that define a first wager amount, wherein the acceptance from the second betting party comprises wager terms that define a second wager amount that is less than the first wager amount, and wherein the smart betting contract in the data block defines the wager as the second wager amount.

9. The system of claim 8, wherein the plurality of betting parties comprises a third betting party, wherein the data block comprises a first data block, wherein the smart betting contract comprises a first smart betting contract, whether the acceptance comprises a first acceptance, wherein the processor circuit further:

receives a second acceptance from a third betting party that comprises wager terms that define a third wager amount; and generates, within the blockchain, a second data block that comprises a second smart betting contract, wherein the second acceptance from the third betting party comprises wager terms that define a third wager amount, wherein the second smart betting contract comprises the third wager amount, and wherein a sum of the second wager amount and the third wager amount is less than the first wager amount.

10. The system of claim 8, wherein the plurality of betting parties comprises a third betting party, wherein the data block comprises a first data block, wherein the smart betting contract comprises a first smart betting contract, whether the acceptance comprises a first acceptance, wherein the processor circuit further:

receives a second acceptance from a third betting party that comprises wager terms that define a third wager amount; and generates, within the blockchain, a second data block that comprises a second smart betting contract, wherein the second acceptance from the third betting party comprises wager terms that define a third wager amount, wherein the second smart betting contract comprises a fourth wager amount that is different from the first, second and third wager amounts, and wherein a sum of the second wager amount and the third wager amount is greater than the first wager amount.

11. The system of claim 7, wherein the betting offer data is received via a graphical user interface on a computing device that is communicatively coupled to the processor circuit.

12. The system of claim 7, wherein the betting offer data comprises an identity of the second betting party, wherein the acceptance data is only received from the second betting party.

13. The system of claim 1, wherein, prior to generating the data block, the processor circuit receives payment data correspond to receipt of payment from the first betting party and the second betting party.

14. The system of claim 1, wherein the decentralized distributed peer-to-peer wagering architecture comprises a blockchain, wherein the blockchain comprises a decentralized distributed digital ledger of the wager between the first betting party and the second betting party, and wherein the smart betting contract is self-executing responsive to a condition that is defined therein being satisfied.

15. A method of operating a wagering system server, comprising:

receiving, from a first wagering terminal that corresponds to a first betting party and into the wagering system server, betting offer data corresponding to a betting offer from the first betting party, the betting offer data defining wager terms for a smart betting contract;

receiving, from a second wagering terminal that corresponds to a second betting party and into the wagering system server, acceptance data that corresponds to an acceptance from the second betting party that indicates that the second betting party has accepted the betting offer from the first betting party;

generating, by the wagering system server and within a blockchain, a data block that comprises the smart betting contract that manages the wager between the first betting party and the second betting party and that corresponds to an event;

determining a wager outcome based on a condition that is defined in the smart betting contract; and based on the wager outcome, executing the smart betting contract to cause a value that corresponds to the wager to be automatically transmitted to a corresponding one of the first betting party and the second betting party.

16. The method of claim 15, wherein the smart betting contract comprises validation data that identifies a validation source that provides data corresponding to an outcome of the event, wherein responsive to determining that the wager outcome corresponds to a first event outcome, the smart betting contract causes the value to be transmitted to the first betting party, and wherein responsive to determining that the wager outcome corresponds to a second event outcome that is different from the first event outcome, the smart betting contract causes the value to be transmitted to the second betting party.

17. The method of claim 15, wherein the condition that is defined in the smart betting contract comprises a fault condition that occurs based on an outcome of the event being undetermined, and wherein based on the fault condition occurring, executing the smart betting contract causes a fault condition portion of a value that corresponds to the wager to be transmitted to each of the first betting party and the second betting party.

18. The method of claim 15, wherein prior to generating the data block, further comprising receiving an indication corresponding to a third party that controls a portion of the value that corresponds to the wager for the first betting party and the wager for the second betting party, wherein the event comprises one of a first event outcome and a second event outcome, and wherein, based on the event comprising the second event outcome, causing the third party to associate the value that corresponds to the wager with the second betting party.

19. The method of claim 15, wherein prior to generating the data block that comprises the smart betting contract that manages the wager is between the first betting party and the second betting party, the method further comprising:

receiving betting offer data corresponding to a betting offer from the first betting party that defines wager terms for the smart betting contract; and receiving acceptance data that corresponds to an acceptance from the second betting party that indicates that the second betting party has accepted the betting offer from the first betting party, wherein the betting offer data received from the first betting party comprises wager terms that define a first wager amount, wherein the acceptance from the second betting party comprises wager terms that define a second wager amount that is different than the first wager amount, and wherein the smart betting contract in the data block defines the wager as a lower one of the first and second wager amounts.

20. A system comprising:

a communication interface;

a processor circuit; and a memory coupled to the processor circuit, the memory comprising machine readable instructions that, when executed by the processor circuit, cause the processor circuit to:

receive, via the communication interface and from a first wagering terminal, betting offer data corresponding to a betting offer from a first betting party, the betting offer data defining wager terms for a smart betting contract;

receive, via the communication interface and from a second wagering terminal, acceptance data that corresponds to an acceptance from a second betting party that indicates that the second betting party has accepted the betting offer from the first betting party to form a wager;

generate, using the processor circuit and within a blockchain, a data block that comprises the smart betting contract that manages the wager between the first betting party and the second betting party and that corresponds to an event; and determine a wager outcome based on a condition that is defined in the smart betting contract, wherein based on the wager outcome, the smart betting contract automatically self-executes to cause value that corresponds to the wager to be transmitted to a corresponding one of the first betting party and the second betting party.

* * * * *